US005948372A

United States Patent [19]

Robert

[11] Patent Number: 5,948,372

[45] Date of Patent: Sep. 7, 1999

[54] DEVICE FOR DESTROYING REACTION GASES BY INCINERATION

[75] Inventor: Philippe Gerald Robert, Poncey, France

[73] Assignee: Eastman Kodak Company, Rochester, N.Y.

[21] Appl. No.: 08/665,067

[22] Filed: Jun. 11, 1996

[30] Foreign Application Priority Data

Jun. 12, 1995 [FR] France ..... 9507168

[51] Int. Cl.[6] ..... B01D 50/00; B01D 17/06

[52] U.S. Cl. ..... 422/183; 422/186; 422/182; 588/204; 205/688

[58] Field of Search ..... 205/688; 210/748; 422/183, 186; 588/204

[56] References Cited

U.S. PATENT DOCUMENTS

| | | | |
|---|---|---|---|
| 4,780,284 | 10/1988 | Zeff et al. | 422/186.3 |
| 4,941,957 | 7/1990 | Zeff et al. | 204/157.3 |
| 5,277,775 | 1/1994 | Neale | 204/269 |
| 5,295,448 | 3/1994 | Vickery | 110/214 |

FOREIGN PATENT DOCUMENTS

| | | | |
|---|---|---|---|
| A 0 490 283 | 6/1992 | European Pat. Off. . | |
| 0 525 974 | 2/1993 | European Pat. Off. | A62D 3/00 |
| 0 729 915 | 9/1996 | European Pat. Off. | C02F 1/46 |
| A 2 074 025 | 10/1971 | France . | |
| A 2 235 092 | 1/1975 | France . | |
| 3729113 | 9/1987 | Germany . | |
| A 36 42 041 | 6/1988 | Germany . | |
| A 95 07373 | 3/1995 | WIPO . | |

*Primary Examiner*—Hien Tran
*Assistant Examiner*—James Kennedy
*Attorney, Agent, or Firm*—John R. Everett

[57] ABSTRACT

A device for destroying by electro-oxidation a photographic solution having at least one photographic developer. The device comprises a) an electro-oxidation unit adapted to degrade the photographic developer into volatile organic compounds and to produce hydrogen and oxygen, b) an expansion reservoir designed to contain the gaseous mixture generated by said electro-oxidation unit; and c) a combustion unit supplied with the gaseous mixture from the expansion reservoir.

8 Claims, 2 Drawing Sheets

DEVICE FOR DESTROYING REACTION GASES BY INCINERATION

FIELD OF THE INVENTION

The present invention concerns a method and a device for destroying reaction gases. The invention applies notably to the destruction of gases such as the volatile organic compounds (VOCs) and halogenated organic compounds (VOXs) produced by the electro-oxidation of photographic developers in an electrolysis cell. The invention can also be applied to any undesirable reaction gas. By way of example, organic solvents in gas form might be cited.

Patent application FR 95/02729 filed on Mar. 3, 1995 in the name of the applicant describes a method and a device for treating by electrolysis solutions containing one or more used photographic developers so as to degrade and eliminate the components with a high chemical oxygen demand (COD).

FIG. 1, to which reference is now made, illustrates a device such as the one used in the treatment by electrolysis described in the patent application referred to above. The solution of developers which forms the electrolyte circulates in a closed loop in the installation. The electrolyte initially present in its totality in the expansion tank (4) is sent into the cooling coil (3) by means of the peristaltic pump (2). It then passes into the electrolysis cell (1), to emerge and be found in part in the expansion tank (4). The electrolysis cell is a closed, non-compartmentalized cell, preferably compact, comprising one or more platinum anodes and one or more titanium or stainless-steel cathodes, separated by an insulating joint. The anodes are SHOWA anodes consisting of titanium covered in pure platinum, which are in the form of metal plates or expanded-metal plates if the electrolyte circulation is parallel to the electrodes, and in the form of one expanded-metal plate if the electrolyte circulation is perpendicular to the electrodes.

The expansion tank is provided with a calibrated orifice which enables a pressure close to atmospheric pressure to be maintained. This tank serves to cushion variations in the volume of the solution and to reduce the pressure of the gases produced during treatment (hydrogen, oxygen, carbon dioxide, volatile organic compounds (VOCs) and volatile halogenated organic compounds (VOXs)) to a pressure close to atmospheric pressure, and is used for the continuous addition of reagents. A device (5) enables the temperature in the expansion tank and coil (3) to be measured and regulated.

A pH regulation loop is composed of a pH measurement device (7) inserted between the electrolysis cell (1) and the expansion tank (4), and a regulator (8) which measures the divergence from the reference value and triggers the pumps, sending an acid (9) or base (9') solution to keep the pH constant.

A peristaltic pump (not shown) enables the anti-foaming agent to be introduced into the cell at the outset of electrolysis or as soon as the presence of foam is detected.

The use of the electro-oxidation device described in the application referred to above presents two major problems. The first is related to the treatment of the hydrogen produced by the reaction, which, mixed with air in a proportion of between 4 and 75% by volume, is explosive and may cause, in addition to major damage to equipment, physical injury. Such a problem entails minimizing the quantities of gases produced, keeping them at low pressure and low temperature, and discharging the excess gases following their dilution in air or in nitrogen so that the hydrogen concentration is below the limits presenting a danger of explosion, that is to say below 4%. To this end, equipment and operating procedures are used in which the level of safety substantially increases the cost of the operation. Thus, in the device in FIG. 1, an air inlet (10) enables gases which present a risk of explosion (hydrogen and oxygen) to be diluted before they are discharged into the atmosphere.

The second problem lies in the generation of toxic gases such as VOCs and VOXs. According to the approach described in this application, the use of a device (6) for trapping the VOCs and VOXs is suggested, such as a cartridge containing an adsorbent substance, for example activated carbon. These gases can also be exposed to ultraviolet radiation (EP-A-0 360 941), oxidized catalytically or washed over sulphuric acid.

Numerous combustion techniques have already been used to destroy such reaction gases, in particular with VOCs and VOXs.

According to a first approach, as described in the patent DE-A-3 729 113, the VOCs and VOXs are destroyed by catalytic incineration. The main problem with this technique, apart from the risk of the catalytic reaction running away if the correct gas concentrations for the catalytic mass are not maintained, lies in the fact that, for a large quantity of gases to be destroyed, it necessitates a large quantity of catalyst. Generally, it is used solely to destroy traces. Moreover, catalysts are specific to specific substances to be destroyed, which can entail the use of several catalysts when there is a mixture of different substances. Furthermore, another drawback is the poisoning of the catalysts, either by substances coming from the oxidation reaction or by substances which do not oxidize but which poison the catalyst. By way of example, the halogenated compounds produced by electro-oxidation of photographic developers are reaction inhibitors for catalysts with a noble metal base, such as platinum.

According to another approach, described for example in the patent U.S. Pat. No. 5,295,448 and EP-A-490 283, thermal combustion is carried out using external fuels such as natural gas, propane, butane, etc. The problem with this approach lies in the fact that it requires large quantities of such fuels to be stored, which is very onerous from the point of view of safety and space.

According to yet another approach, the VOCs and VOXs are destroyed by corona effect. This approach calls for large quantities of electrical energy.

The patent EP-A-525 974 describes a method of catalytic destruction at medium temperature (400° C.) consisting of passing the gaseous mixture over a catalyst on which adsorption occurs in the presence of oxygen, and subjecting the reactor to a temperature of around 400° C. in order to produce either oxidation or hydrolysis. The main problem with this solution relates to the fact that it could not be applied to a gaseous mixture containing hydrogen such as that produced by electro-oxidation of photographic developers, other than by reducing the hydrogen concentration to below 4%.

Thus one of the objects of the present invention is to provide a method and device for destroying reaction gases by combustion, which do not have the drawbacks referred to above with reference to the known techniques.

Another object of the present invention is to enable a mixture of gases to be destroyed by using as the principal fuel hydrogen generated by the reaction producing the gases to be destroyed, and this in complete safety.

Other objects will emerge in detail in the description which follows.

BRIEF SUMMARY OF THE INVENTION

These objects are attained by means of a method for destroying by combustion a reaction gas or a mixture of reaction gases in which hydrogen is used as the principal fuel in the presence of oxygen, and in which the principal fuel is generated in situ by an electrolysis reaction.

By way of example, the electrolysis reaction consists of an electro-oxidation reaction in a solution comprising one or more used photographic developers, the mixture of reaction gases including volatile organic compounds and halogenated organic compounds produced by the said electro-oxidation reaction.

The invention also concerns a device for destroying by combustion a reaction gas or a mixture of reaction gases, comprising:

a) a combustion unit supplied with reaction gas and fuel and in which the combustion of the gaseous mixture is carried out in the presence of oxygen;

b) supply means designed to supply the combustion unit with reaction gases and with principal fuel required for the combustion of the gaseous mixture;

c) means designed to isolate the combustion unit from the supply means, the said device being characterised in that the principal fuel is hydrogen and in that the supply means comprise an electrolysis unit generating the principal fuel.

Advantageously, the electrolysis unit is a cell for the electro-oxidation of solutions containing one or more photographic developers so as to degrade and eliminate the compounds with a high chemical oxygen demand, the mixture of reaction gases containing VOCs and VOXs.

Also advantageously, the device according to the invention comprises:

a) an electro-oxidation unit generating principally oxygen, hydrogen, VOCs and VOXs;

b) a reservoir designed to contain the gaseous mixture generated by the said electro-oxidation unit;

c) a combustion unit comprising principally a burner and means for initiating the combustion of the gaseous mixture coming from the said reservoir;

d) a plurality of non-return hydraulic devices disposed in series between the reservoir and the combustion unit so as to isolate the combustion unit from the said reservoir; and e) means preventing any return of water contained in the hydraulic devices to the reservoir (30).

The combustion unit preferably has an air or oxygen inlet connected to the burner and whose flow can be varied in order, selectively, to provide a supplementary oxygen supply required for combustion, or to stop the combustion.

According to another characteristic of the device according to the invention, the combustion unit also comprises a platinum coil disposed in the vicinity of the burner and designed to maintain and complete the combustion.

BRIEF DESCRIPTION OF THE DRAWINGS

In the description which follows, reference will be made to the drawing in which.

DETAILED DESCRIPTION OF THE INVENTION

The invention is based on the observation that it is particularly advantageous to produce the fuel required for the combustion of the gases to be destroyed directly on the site where the destruction takes place. Such a concept covers principally three types of situation:

A first situation in which the reaction gases to be destroyed and the principal fuel required to destroy them are generated by a single electrolysis reaction (an electro-oxidation reaction in photographic developers, for example).

A second situation in which the reaction gases are generated independently of any production of hydrogen. In such case, an electrolysis cell is used as an external source for producing in situ the hydrogen required for combustion.

A third situation in which the hydrogen is generated at the same time as the reaction gases, but in a quantity that is insufficient for ensuring the combustion of all the gases to be destroyed. In such case, an external electrolysis cell is also used to supplement the device producing the reaction gases.

For the last two situations, an external electrolysis cell is used which comprises in its most simple form a cathode, and an anode in a support electrolyte such as nitric or sulphuric acid or sodium sulphate.

Figure 1:
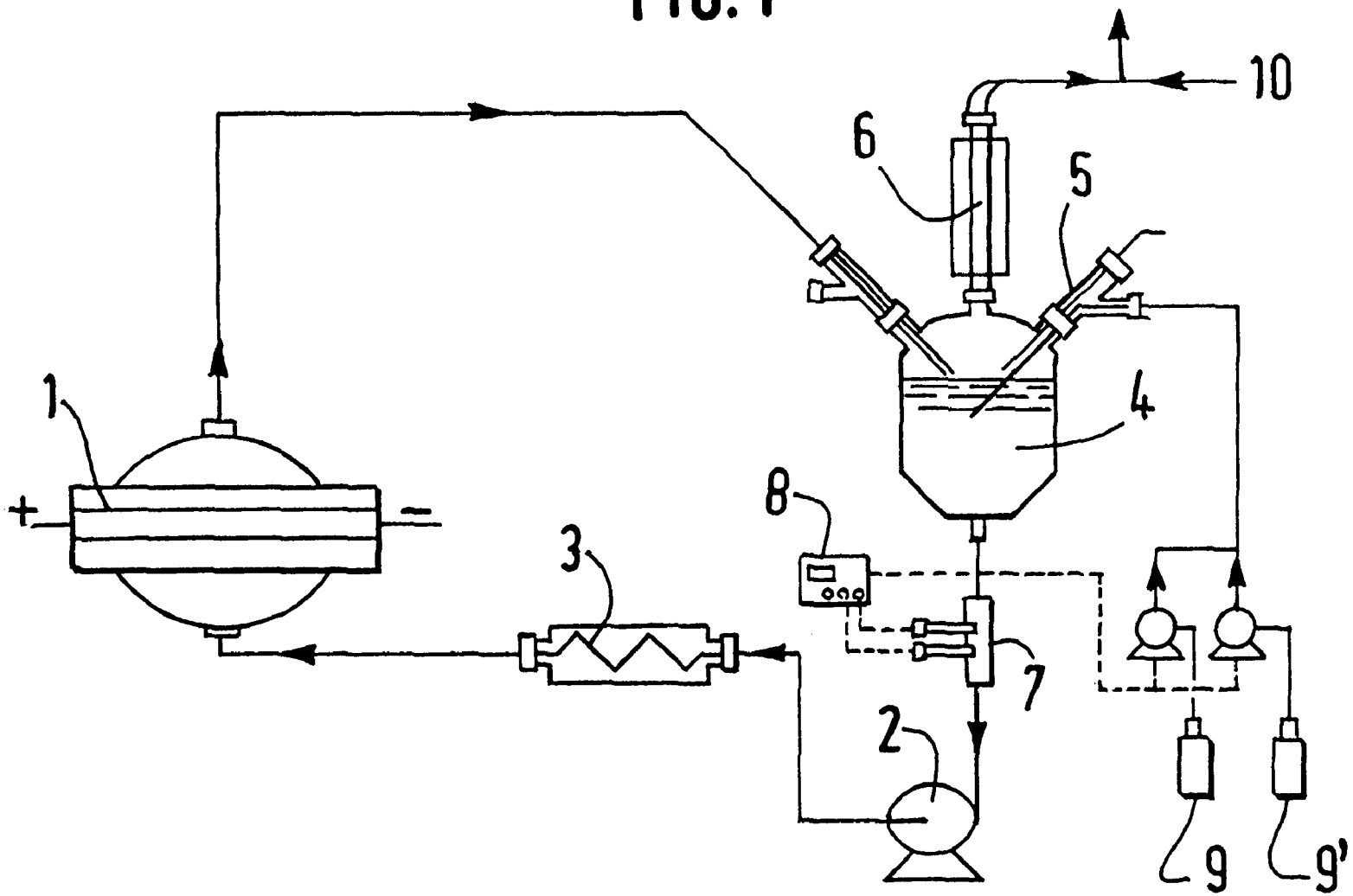
FIG. 1 depicts an electrolysis cell generating simultaneously the reaction gases to be destroyed and the principal fuel required for their destruction.
Figure 2:
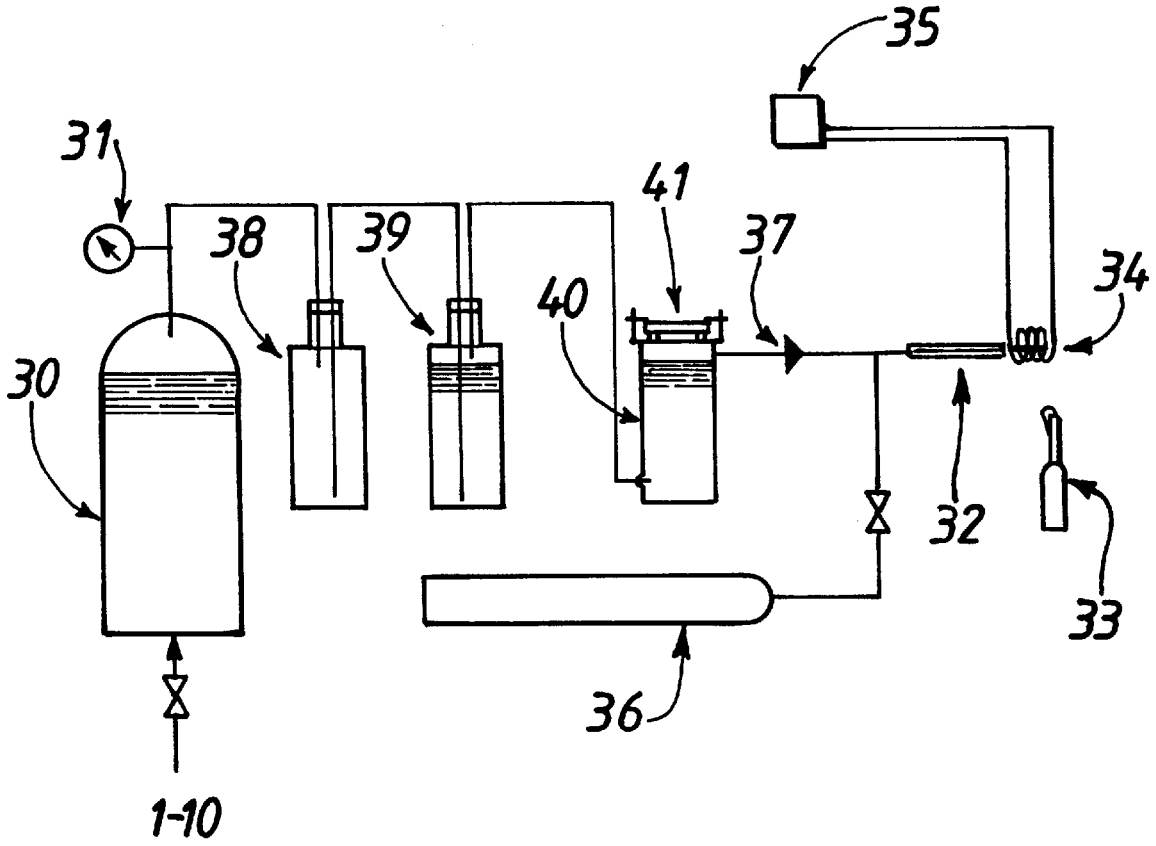
FIG. 2 depicts an advantageous embodiment of the device according to the present invention.

The part which follows, with reference to FIG. 2, describes in detail a preferred embodiment in which the mixture of gases to be destroyed consists of a mixture of VOCs and VOXs generated by electro-oxidation of photographic developers in an electrolysis cell in accordance with that described with reference to FIG. 1. As mentioned with reference to the latter figure, the gaseous mixture (principally VOCs, VOXs, hydrogen and oxygen) produced by the electro-oxidation reaction accumulates in an expansion reservoir 30, at the top of which a valve is preferably provided for the escape of the gases when the pressure inside the reservoir reaches a given value so as to compensate for any pressure drops in the supply circuit of the combustion unit, a pressure detector 31 being provided in order to measure the pressure at the output from the reservoir 30. Typically, this pressure is around 100 mbar.

The gaseous mixture is channelled to the combustion unit, comprising principally a burner 32 formed typically by a burner nozzle whose diameter is chosen according to the flow of gaseous mixture so as to ensure a sufficient speed of gas flow into the burner. For example, for electrolysis carried out with a current of 34 A, a burner is used whose diameter is around 0.5 mm, which permits a gaseous mixture speed of between 20 and 30 m/s. The speed of the gas flow must be greater than the speed of movement of the flame in the burner so as to prevent flash-back to the reservoir 30. Typically, for a gaseous mixture comprising 29.5% hydrogen and 70.5% air, the speed of the flame at ambient pressure (having travelled 10 cm) is around 19 m/s. This difference in speed is sufficient for preventing any flash-back of the flame to the expansion reservoir. Furthermore, the initial temperature of the gaseous mixture coming from the reservoir 30 is sufficiently low (generally below 50° C.), which, for many organic gases and compounds, is significantly lower than the auto-ignition temperature (typically above 250° C.).

At the burner outlet, means 33 are disposed (an automatic-ignition torch, for example) for initiating the combustion of the mixture. The VOCs and VOXs are then transformed by thermal combustion into acids of low molecular weight (HCl, HBr, HI, etc), and into carbon dioxide, sulphur dioxide and nitrogen. No other additional treatment (except, optionally, an alkaline trap for neutralizing acidic discharges and other by-products) is required at the outlet from the combustion unit.

Furthermore, and according to a preferred embodiment of the device according to the present invention, a platinum filament 34 (in the form of a coil) is disposed at the outlet of the burner 32. The platinum filament has a number of functions. Firstly, it enables the flame to be re-ignited if it is extinguished following a disturbance (by an air current, for example) in the environment of the burner 32. Furthermore, because of its colour during combustion (substantially red), it provides an operator with a signal that combustion has indeed taken place, which, for certain flame colours (blue, notably), could be difficult to see otherwise. Also advantageously, the two ends of the platinum filament 34 are connected to means 35 for measuring the resistance in the coil 34, the said measured resistance being representative of the combustion temperature. The combustion temperature is an important parameter for the process since, at certain temperatures, the combustion of the VOCs and VOXs can generate undesirable substances. Thus the combustion temperature is preferably between 500 and 1300° C., so that the formation of nitrogen oxide is avoided.

The combustion temperature can be adjusted in different ways. According to one embodiment, an air or oxygen input 36 with variable flow is used. This air or oxygen supply enables the temperature of the gaseous mixture to be cooled down and its hydrogen level reduced, thereby lowering the combustion temperature. The reaction can thus be halted by cooling the mixture sufficiently. This input also enables all or part of the quantity of oxygen required for combustion to be supplied, when the gaseous mixture contained in the reservoir 30 does not contain any oxygen, or at least not in sufficient quantities.

Preferably, the safety of the system is further increased by inserting a certain number of safety devices in the supply circuit of the combustion unit.

Thus, at the inlet to the combustion unit, there is disposed a flame arrester 37. These devices are well known, and include, for example, a device of the honeycomb type designed to prevent the propagation of a flame coming from the burner. Other cooling systems can be envisaged. By way of example, a cooling circuit in the form of a coil immersed in a cooling liquid is used. These devices are well known and consequently require no additional description.

A plurality of non-return devices 38, 39, 40 disposed in series between the reservoir 30 and the burner 32 can also be used. According to the embodiment illustrated in FIG. 2, two hydraulic non-return devices 39, 40, designed to isolate the reservoir 30 from the combustion unit, are used.

Advantageously, the device 40 has a safety valve 41 of the bursting disk type, enabling physical damage to be minimized in the event of an abnormal increase in volume or pressure, caused either by excess pressure in the reservoir, should there be a fault in the electro-oxidation device, or by an ignition of the gaseous mixture between the burner and the non-return device 40, if the flame arrester and electro-oxidation device should fail.

Also advantageously, there is, upstream of the non-return hydraulic devices 39, 40, another non-return device 38 disposed so as to prevent any return of water (coming from the hydraulic devices 39, 40) into the reservoir 30 should there be a pressure drop inside the reservoir 30 while the electro-destruction device is idle or when the temperature in the reactor shifts from an operating temperature (typically 40 to 50° C.) to ambient temperature.

The invention that has been described is particularly advantageous in that it provides a simple, risk-free solution to the problem of destroying undesirable reaction gases such as VOCs and VOXs. Furthermore, it enables the risk associated with the destruction of hydrogen generated by reactions such as electro-oxidation reactions to be reduced to the maximum possible extent.

The present invention has been described with reference to preferred embodiments. It is evident that variations can be made thereto without departing from the spirit of the invention as claimed hereinafter.

I claim:

1. Device for destroying by electro-oxidation a photographic solution having at least one photographic developer, comprising:

a) an electro-oxidation unit adapted to simultaneously degrade the photographic developer into at least one volatile organic compound and produce hydrogen and oxygen;

b) an expansion reservoir designed to contain the gaseous mixture generated by said electro-oxidation unit; and c) a combustion unit supplied with the gaseous mixture from the expansion reservoir.

2. Device according to claim 1, comprising:

means designed to isolate the combustion unit from the expansion reservoir.

3. Device according to claim 2 comprising:

a) an electro-oxidation unit generating principally oxygen, hydrogen, VOCs and VOXs;

b) an expansion reservoir (30) designed to contain the gaseous mixture generated by the said electro-oxidation unit;

c) a combustion unit comprising principally a burner and means for initiating the combustion of the gaseous mixture;

a plurality of non-return hydraulic devices disposed in series between the expansion reservoir and the combustion unit so as to isolate the combustion unit from the reservoir; and means situated between the hydraulic non-return devices and the expansion reservoir so as to prevent any return of water present in the hydraulic devices to the reservoir.

4. Device according to claim 3, further comprising a flame arrester disposed at the inlet to the combustion unit.

5. Device according to claim 4, further comprising means disposed on the hydraulic non-return device for limiting the effects related to excess pressure or expansion of the volume of gas upstream of the combustion unit.

6. Device according to claim 1 wherein the combustion unit also comprises a platinum coil disposed in the vicinity of the burner to maintain and complete the combustion.

7. Device according to claim 6, in which the two ends of the coil are connected to means for measuring the resistance in the coil, said resistance being representative of the combustion temperature of the gaseous mixture.

8. Device according to claim 7 wherein the combustion unit comprises an air or oxygen inlet connected to the burner, and whose flow can be varied in order, selectively, to provide a supplementary oxygen supply required for combustion, or to stop the combustion.

* * * * *